US011903437B2

(12) United States Patent
Ernst et al.

(10) Patent No.: US 11,903,437 B2
(45) Date of Patent: Feb. 20, 2024

(54) HARD HAT WITH LIGHT ASSEMBLY

(71) Applicant: Coast Cutlery Co., Portland, OR (US)

(72) Inventors: Todd Ernst, Portland, OR (US); Brian Sheehy, Los Angeles, CA (US); Song YangZhi, Cixi (CN)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 17/334,108

(22) Filed: May 28, 2021

(65) Prior Publication Data

US 2022/0378138 A1 Dec. 1, 2022

(51) Int. Cl.
*A42B 3/04* (2006.01)

(52) U.S. Cl.
CPC ..... *A42B 3/044* (2013.01)

(58) Field of Classification Search
CPC ..... A42B 3/044
See application file for complete search history.

(56) References Cited

U.S. PATENT DOCUMENTS 5,758,947 A 6/1998 Glatt
7,121,676 B1 * 10/2006 Kutnyak ..... A42B 3/044 362/105
8,166,573 B1 * 5/2012 Chung ..... A42B 3/32 2/425
9,968,153 B2 * 5/2018 Thompson ..... A42B 3/0446
2016/0088890 A1 * 3/2016 Armagh ..... A42B 1/242 362/105
2018/0032520 A1 2/2018 Hayrapetian
2018/0325202 A1 11/2018 McAllister
2020/0015832 A1 6/2020 Lombard

FOREIGN PATENT DOCUMENTS

WO WO2020/072825 A1 4/2020

* cited by examiner

*Primary Examiner* — Thomas M Sember
(74) *Attorney, Agent, or Firm* — Schwabe Williamson & Wyatt, P.C.

(57) ABSTRACT

Various embodiments herein provide a hard hat with a removable light assembly. The hard hat includes an outer shell with one or more windows. The removable light assembly is removably coupled to an interior surface of the outer shell. The removable light assembly includes a support structure and one or more lights (e.g., light emitting diodes (LEDs)) coupled to the support structure and positioned behind respective windows of the one or more windows. In embodiments, the light assembly may include an arm that extends from the support structure to an underside of a brim of the outer shell. A power control element may be disposed on the end of the arm to control the one or more lights. Other embodiments may be described and claimed.

19 Claims, 14 Drawing Sheets

HARD HAT WITH LIGHT ASSEMBLY

TECHNICAL FIELD

The present disclosure relates generally to the field of hard hats.

BACKGROUND

Hard hats are widely used to provide head protection for users in various settings, such as construction, bicycling, rock climbing, skateboarding, skiing/snowboarding, and other activities. Many hard hats include reflective elements to provide visibility in low light conditions. However, these reflective elements often get dirty, which can reduce their reflective capability. Additionally, the reflective elements require a light source to shine on them to be effective.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION

Figure 1:
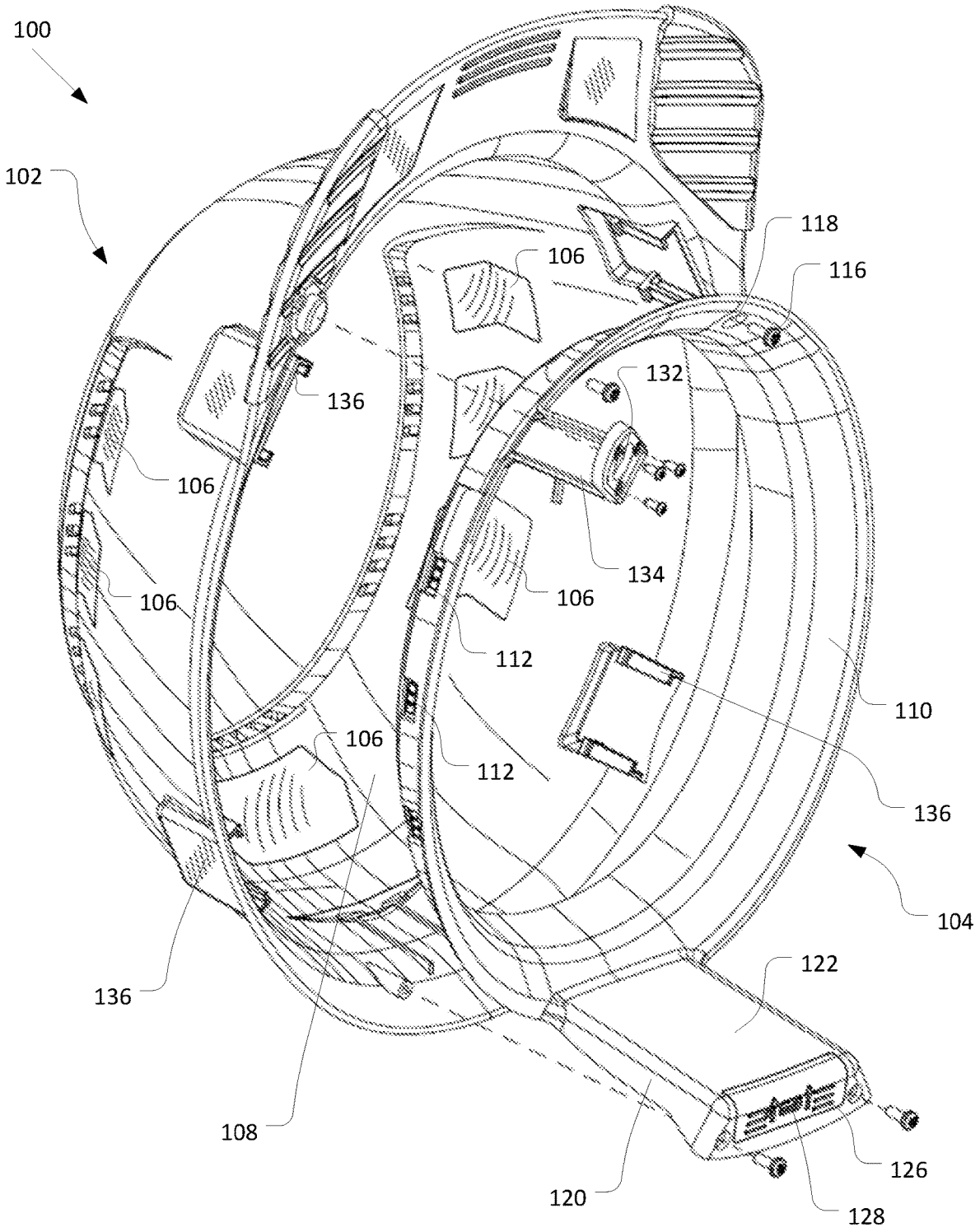
FIG. 1 is a lower perspective exploded view of a hard hat with an outer shell and a removable light assembly, in accordance with various embodiments.
Figure 2:
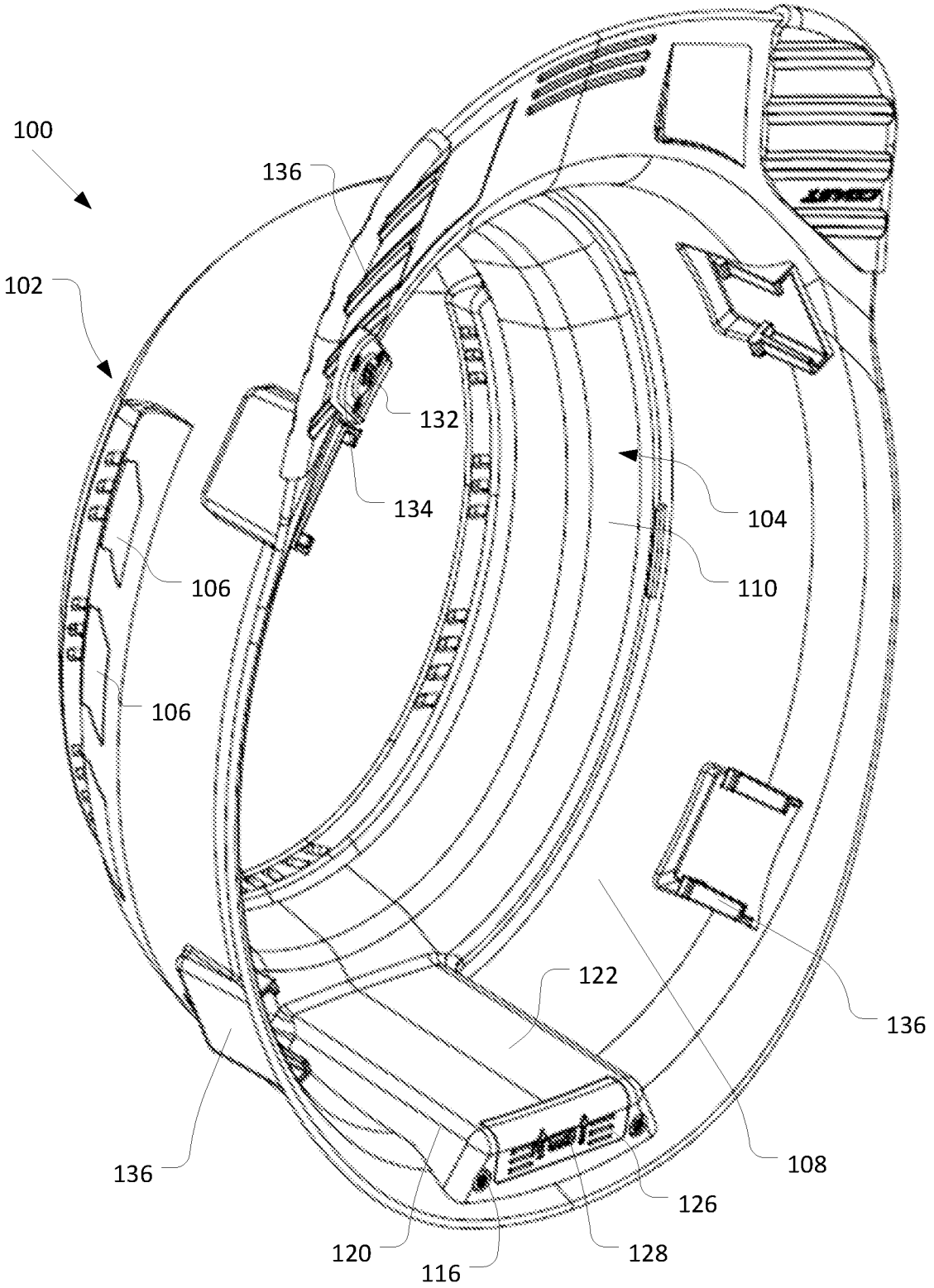
FIG. 2 is a lower perspective view of the hard hat in assembled form, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Various embodiments herein provide a hard hat with a removable light assembly. The hard hat may include an outer shell with one or more windows through which light may shine. The windows may be an opening through the base material of the outer shell. In some embodiments, the windows may be covered by a window covering, such as an opaque or clear material (e.g., plastic or another suitable material). The window covering may include reflective and/or diffusive features (e.g., surfaces, structures, and/or material elements) to distribute light that shines through the window.

In various embodiments, the hard hat may further include a light assembly that is removably coupled to an interior surface of the outer shell. The light assembly may include a support structure and one or more lights (e.g., light emitting diodes (LEDs) and/or other suitable lights) coupled to the support structure. The lights may be positioned behind respective windows of the outer shell when the light assembly is coupled to the outer shell, so that the lights shine through the windows. Each window may have one or more lights positioned behind it.

The support structure may be removably coupled to the interior surface of the outer shell via any suitable mechanism. For example, one or more screws may be inserted through receiving holes of the support structure and engage with threads of the outer shell. The receiving holes may be recessed from the surface of the support structure so that they do not protrude from the surface of the support structure that faces the head of a wearer, thereby providing enhanced safety.

The light assembly may further include a battery compartment to hold one or more batteries that power the lights. In some embodiments, the battery compartment may extend down from a rear of the support structure (e.g., so that it is positioned behind the wearer's head). The battery compartment may include a panel to separate the battery from the wearer's head. The battery compartment may further include a door to enable removal of the battery. The battery may additionally or alternatively be secured to the battery compartment by one or more screws, ridges, walls, and/or other features.

The battery is preferably rechargeable, however single-use batteries may also be used in some embodiments. In some embodiments, the battery compartment may include a passthrough charge port to enable the battery to be charged while the battery is installed in the battery compartment. The passthrough charge port may be in the door or another portion of the battery compartment. The battery may additionally or alternatively include a charge port to engage with the passthrough charge port for charging while the battery is installed and/or enable the battery to be charged while outside of the battery compartment.

In various embodiments, the light assembly may further include one or more control elements to control the lights. The control elements may include, for example, one or more buttons, switches, sliders, and/or other suitable mechanisms. In some embodiments, the one or more control elements may be disposed on an arm that extends from the light assembly to an underside of a brim of the outer shell. Accordingly, the one or more control elements may be accessible by the wearer of the hard hat while the hard hat is being worn. This feature provides a significant safety benefit, since it can be in violation of safety code and/or otherwise dangerous in some circumstances for the wearer to remove the hard hat even for a short time.

The one or more control elements may be used to power the lights on and off and/or control one or more other operational modes of the lights. For example, the operational modes may include, full on, full off, pulsing on (e.g., varying intensity), different colors, etc.

In various embodiments, the light assembly and corresponding outer shell described herein may provide enhanced visibility for the wearer compared with prior solutions. Additionally, the light assembly may be removed from the outer shell, enabling the light assembly to be used with another outer shell, e.g., when the first outer shell becomes damaged or otherwise compromised. Furthermore, if the light assembly needs to be disposed of, it can be separated from the outer shell to enable responsible disposal of the electronic components.

Figure 3:
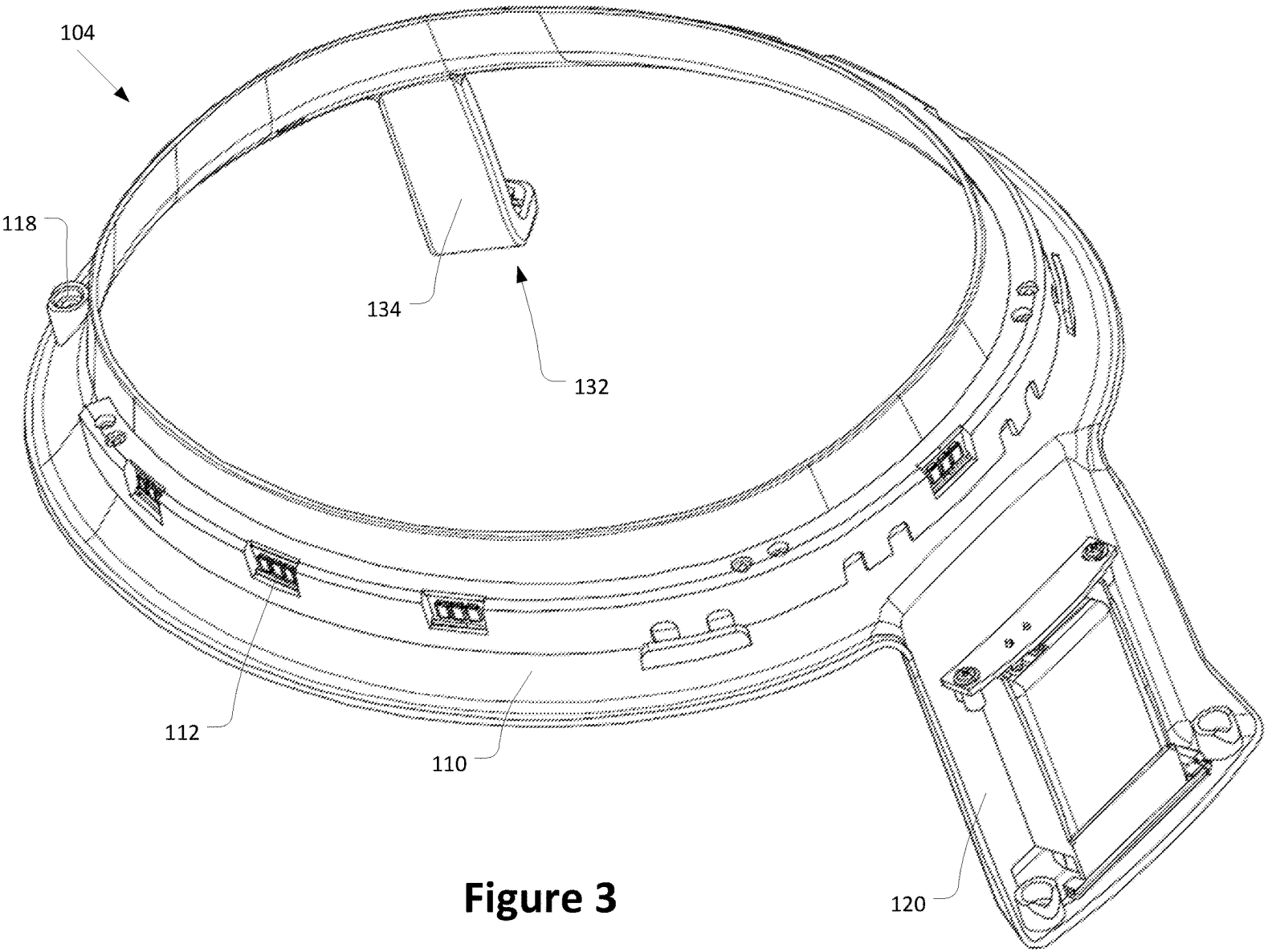
FIG. 3 is a first perspective view of the light assembly, in accordance with various embodiments.
Figure 4:
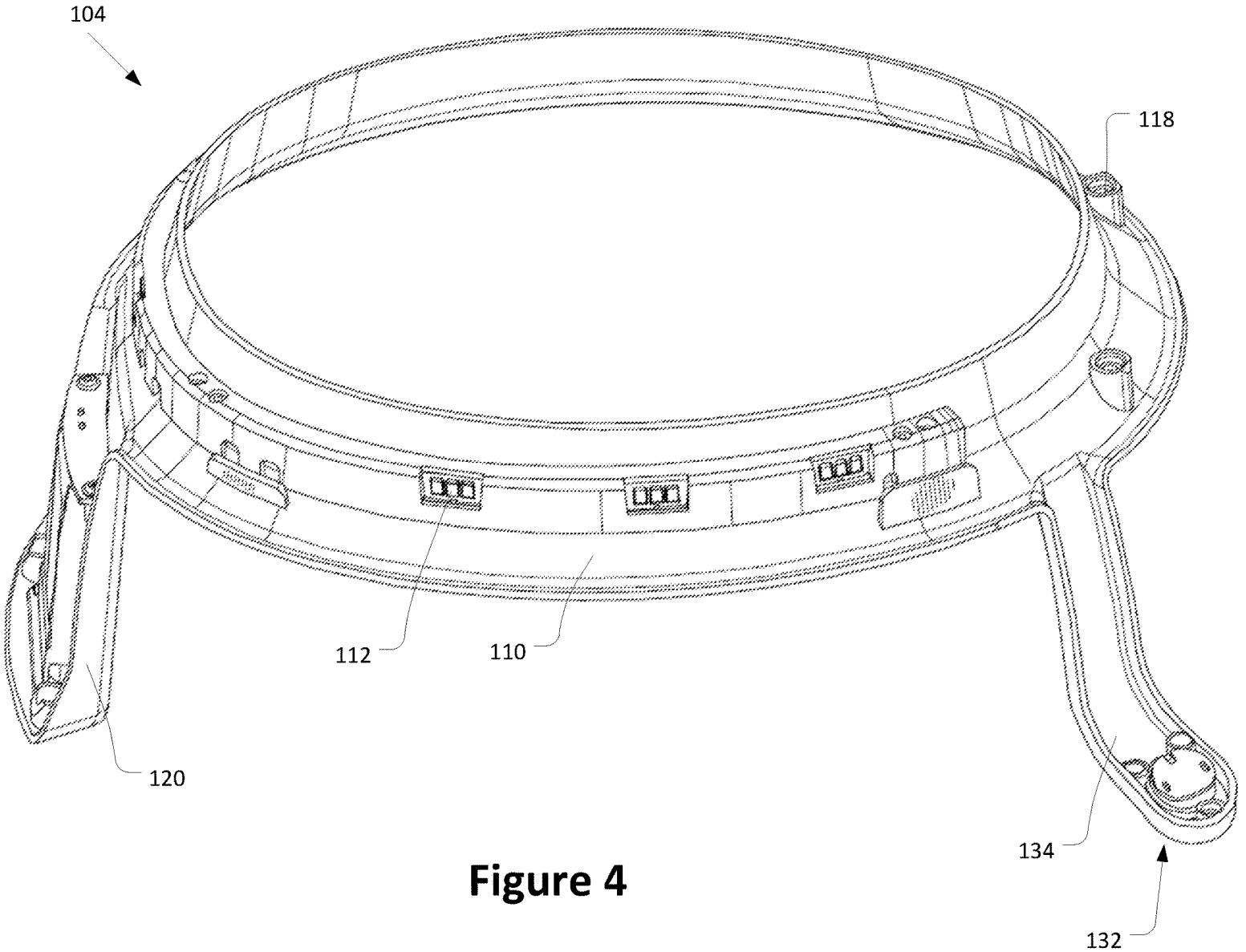
FIG. 4 is a second perspective view of the light assembly, in accordance with various embodiments.
Figure 5:
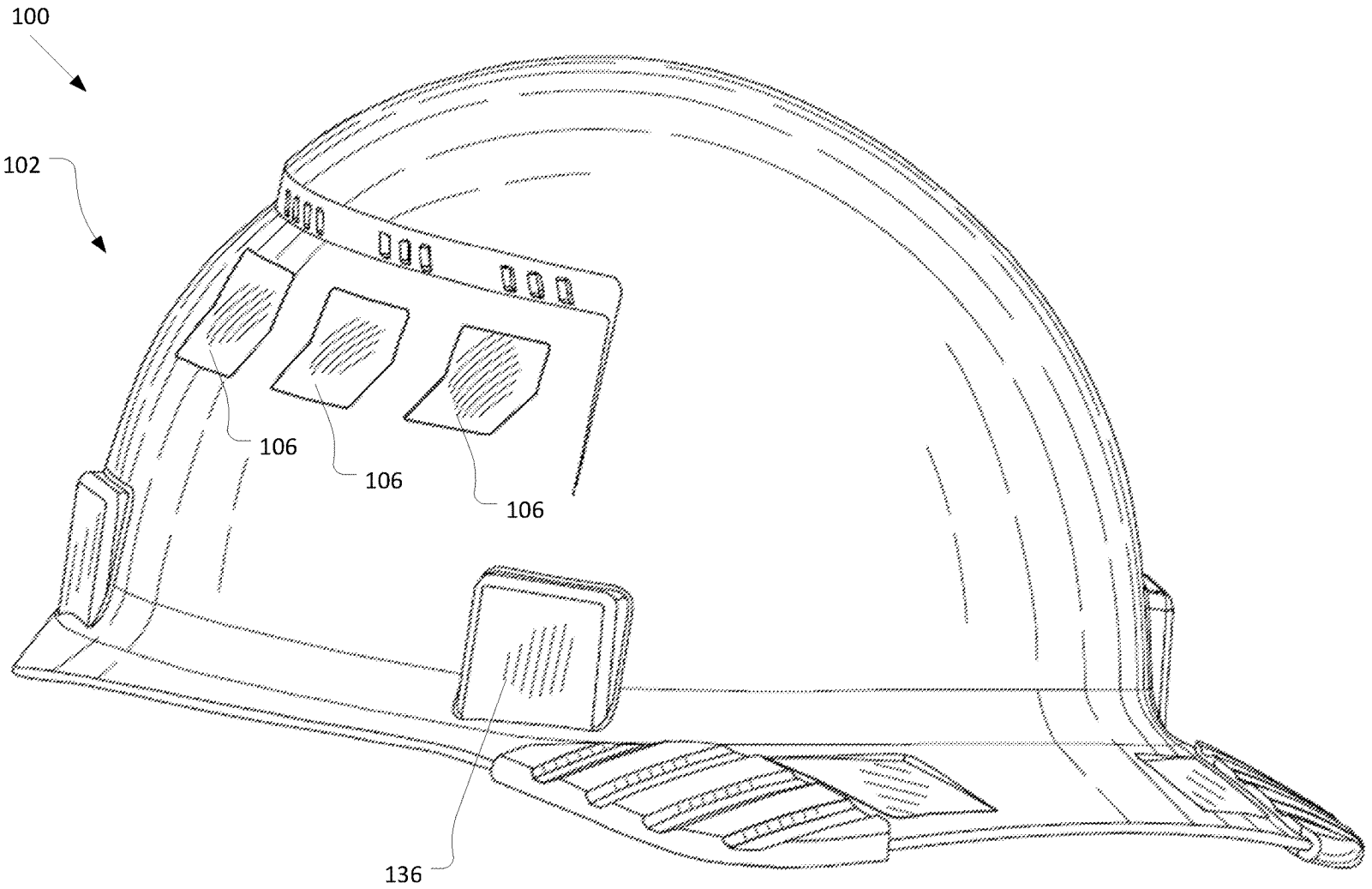
FIG. 5 is a first upper perspective view of the hard hat, in accordance with various embodiments.
Figure 6:
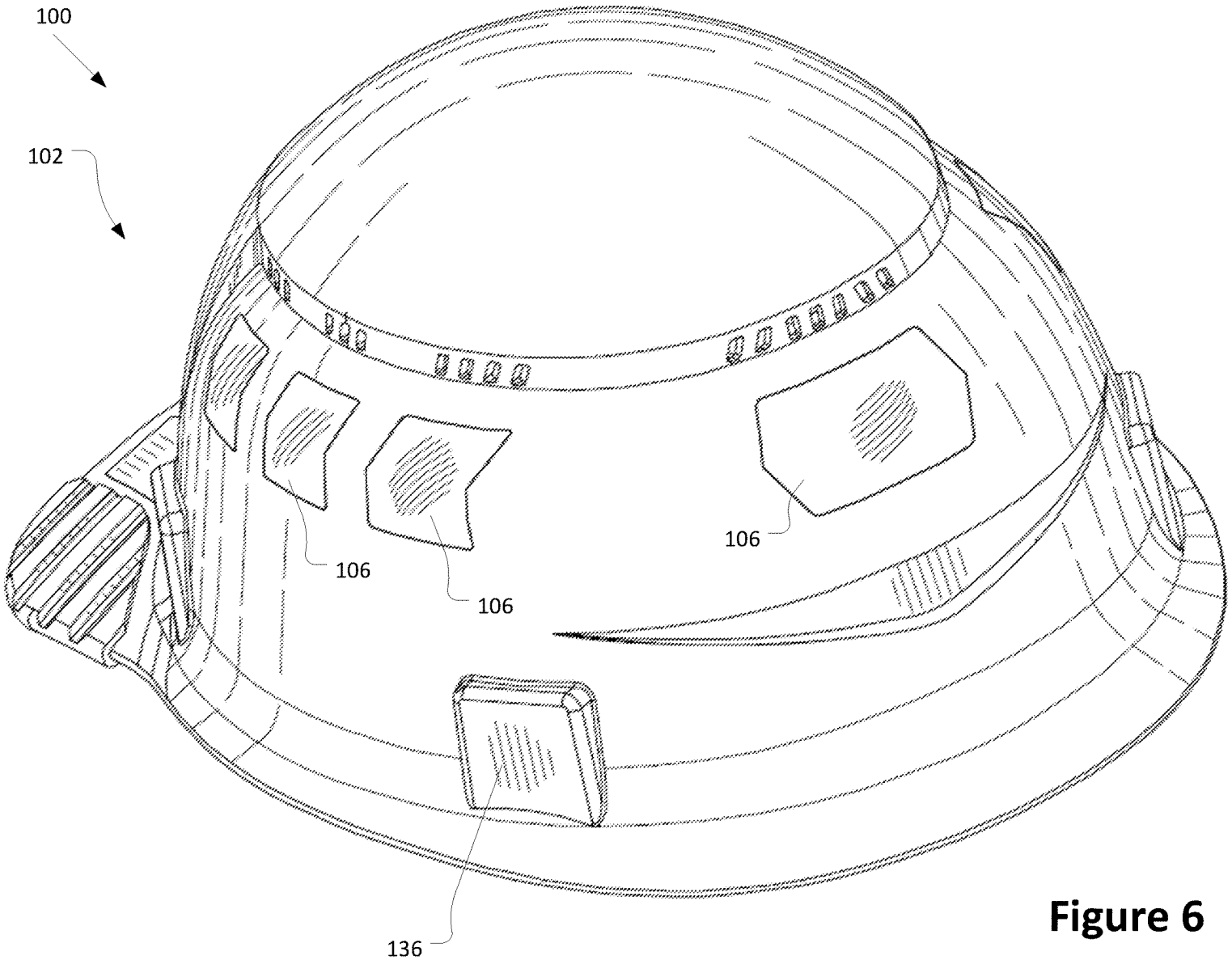
FIG. 6 is a second upper perspective view of the hard hat, in accordance with various embodiments.
Figure 7:
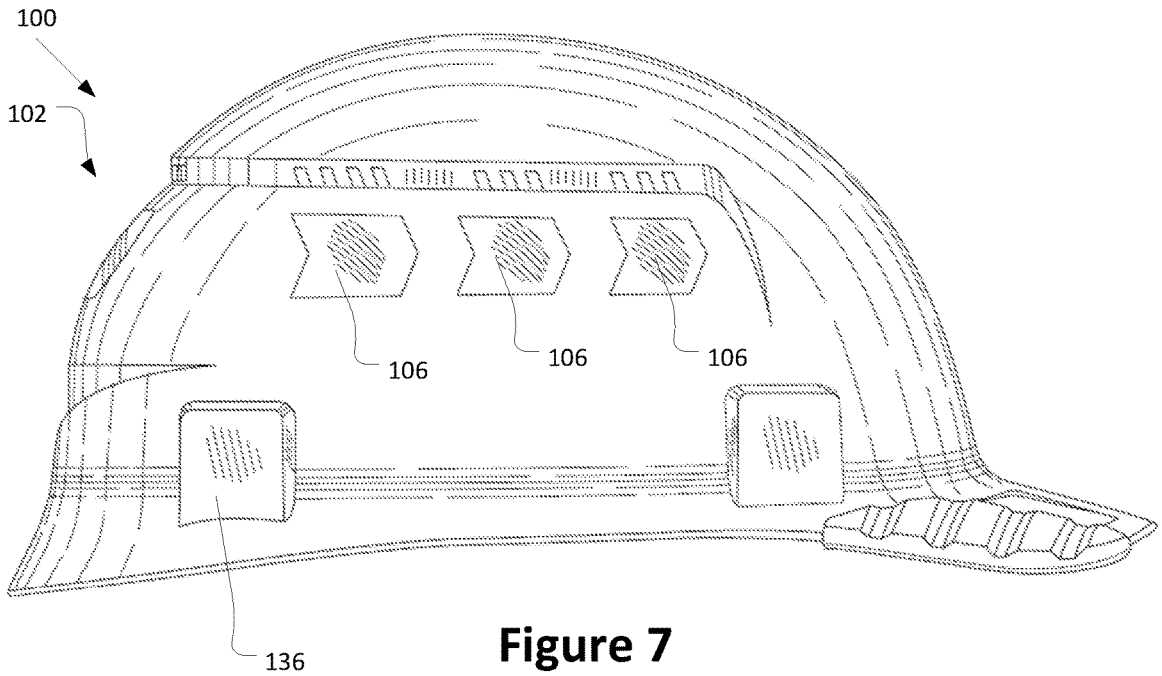
FIG. 7 is a left side view of the hard hat, in accordance with various embodiments.
Figure 8:
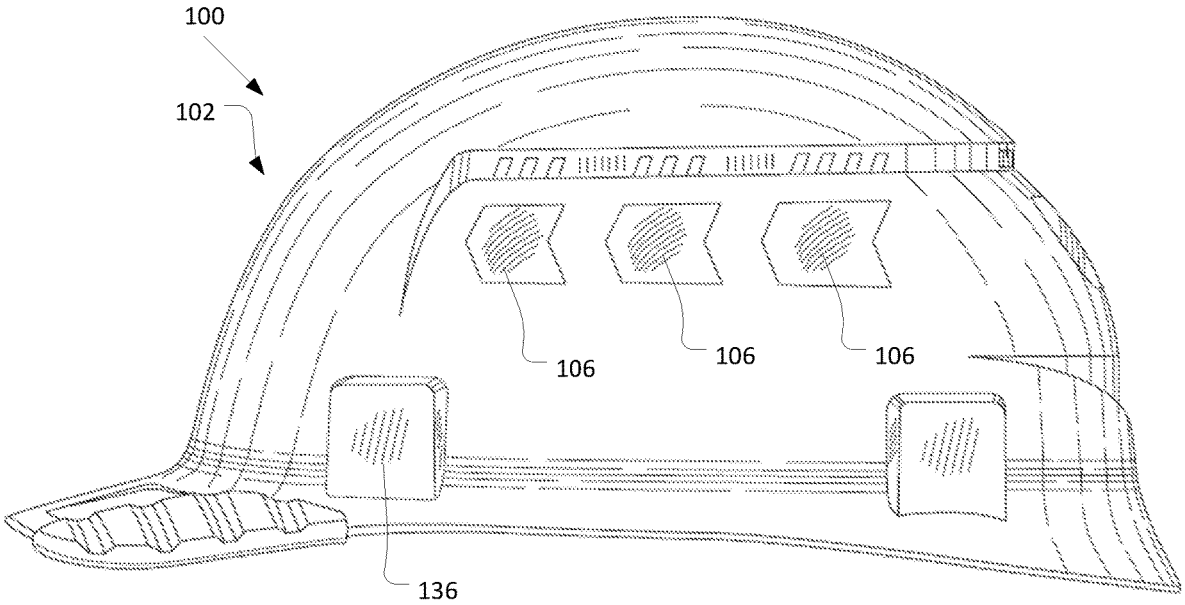
FIG. 8 is a right side view of the hard hat, in accordance with various embodiments.
Figure 9:
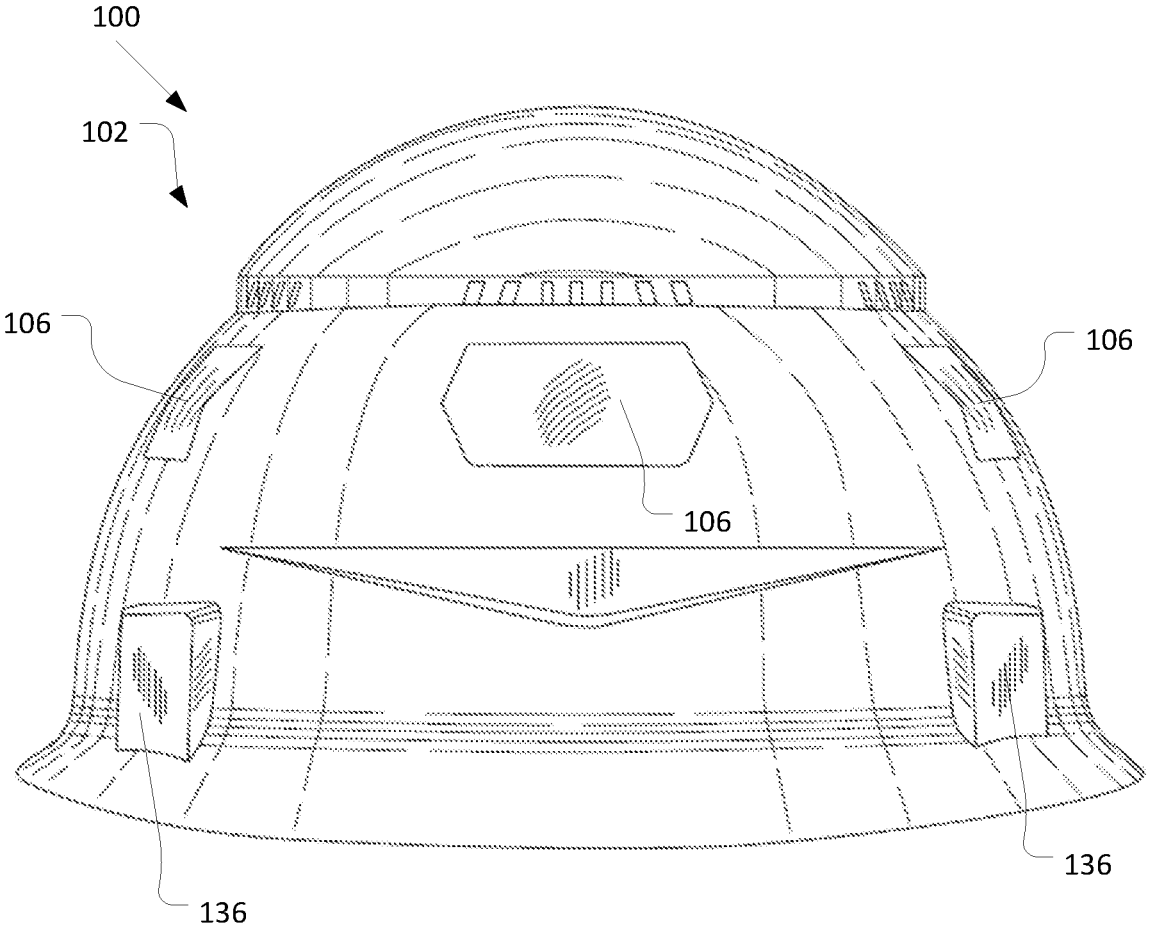
FIG. 9 is a rear view of the hard hat, in accordance with various embodiments.
Figure 10:
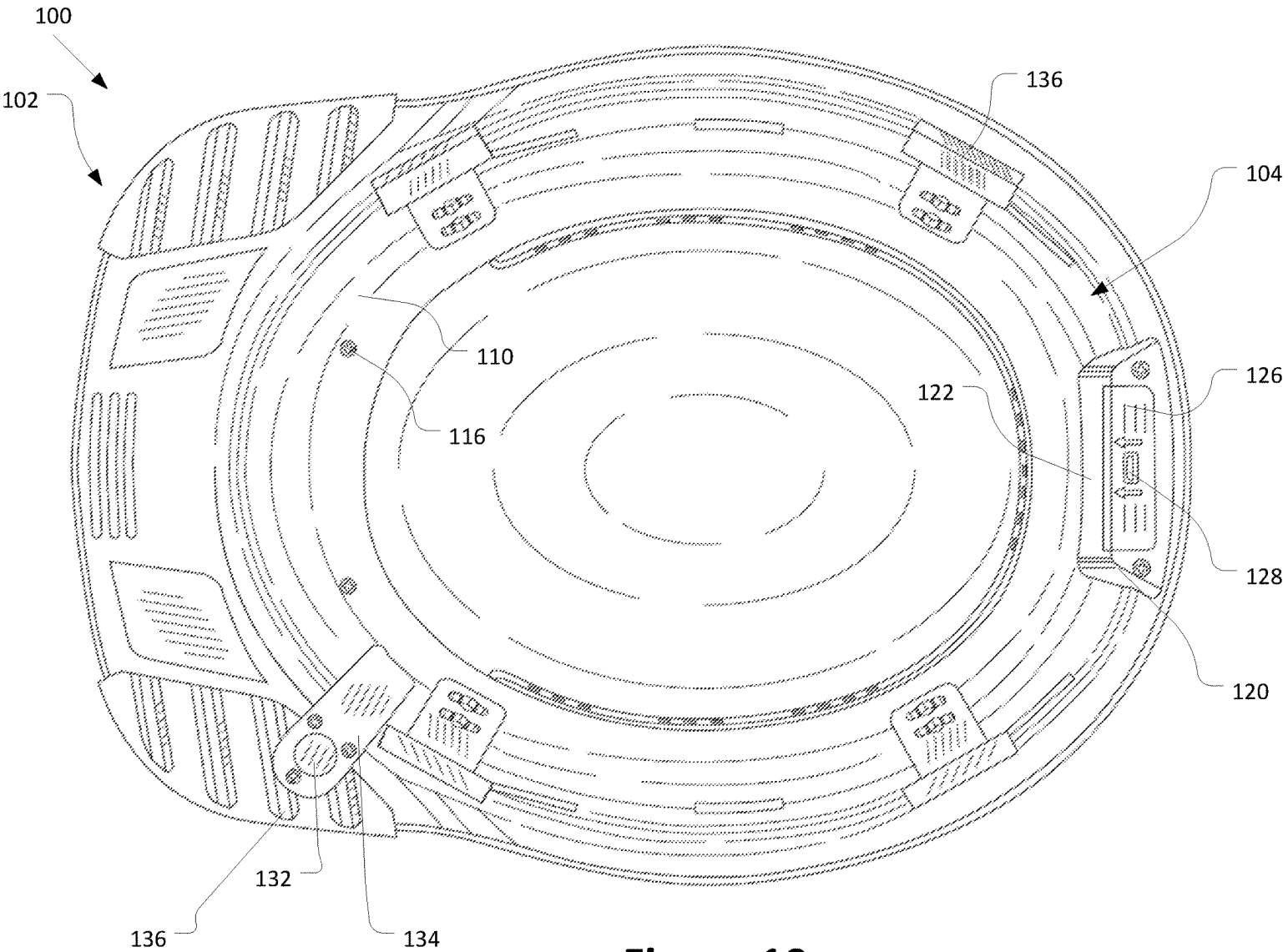
FIG. 10 is a bottom view of the hard hat, in accordance with various embodiments.

FIGS. 1, 2, and 5-10 illustrate a hard hat 100 that includes an outer shell 102 and a removable light assembly 104, in accordance with various embodiments. FIGS. 3 and 4 illustrate the light assembly 104 when it is removed from the outer shell 102.

The outer shell 102 may include one or more relatively hard materials on an outside surface of the outer shell 102, such as a thermoplastic (e.g., polycarbonate, acrylonitrile butadiene styrene (ABS), thermoset resin, etc.), composite fiber material (e.g., carbon fiber, fiberglass), metal, and/or another suitable material. In some embodiments, the outer shell 102 may include one or more other materials inside of the hard exterior material, such as a shock absorbing material and/or structure.

In various embodiments, the outer shell may include one or more windows 106 through which light may shine. The windows 106 may be formed by an opening through the base material(s) of the outer shell. In some embodiments, the opening may be covered by a window covering of the window 106, such as an opaque or clear material (e.g., plastic or another suitable material) that allows light to shine through the window covering. The window covering may include reflective and/or diffusive features (e.g., surfaces, structures, and/or material elements) to distribute light that shines through the window 106.

In various embodiments, the light assembly 104 may be removably coupled to an interior surface 108 of the outer shell 102. The light assembly 104 may include a support structure 110 and one or more lights 112 (e.g., light emitting diodes (LEDs) and/or other suitable lights) coupled to the support structure 110. The lights 112 may be positioned behind respective windows 106 of the outer shell when the light assembly is coupled to the outer shell, so that the lights shine through the windows 106. Each window 106 may have one or more lights 112 positioned behind it.

The outer shell 102 may have any suitable number and/or arrangement of one or more windows 106, such as two or more windows, four or more windows, etc. For example, the embodiment of outer shell 102 depicted in FIGS. 1, 2, and 5-10 includes seven windows 106, with three windows on each of the left and right sides and another window on the rear side of the outer shell 102. The windows 106 on the left and right sides are in the shape of a chevron, while the window 106 on the rear side is in the shape of an elongated hexagon. Other embodiments may include a different number of windows, larger windows, smaller windows, and/or different windows with different shapes.

In some embodiments, the support structure 110 may generally be in the shape of a ring (e.g., oval ring), a "U" shape, or another suitable shape that generally follows the shape of the interior surface 108 of the outer shell 102. The support structure 110 may or may not be a closed shape (e.g., a complete ring). The support structure 110 may be removably coupled to the interior surface of the outer shell via any suitable mechanism. For example, one or more screws 116 may be inserted through receiving holes 118 of the support structure and engage with threads of the outer shell. The receiving holes 118 may be recessed from the surface of the support structure 110 so that they do not protrude from the surface of the support structure that faces the head of a wearer, thereby providing enhanced safety.

Figure 11:
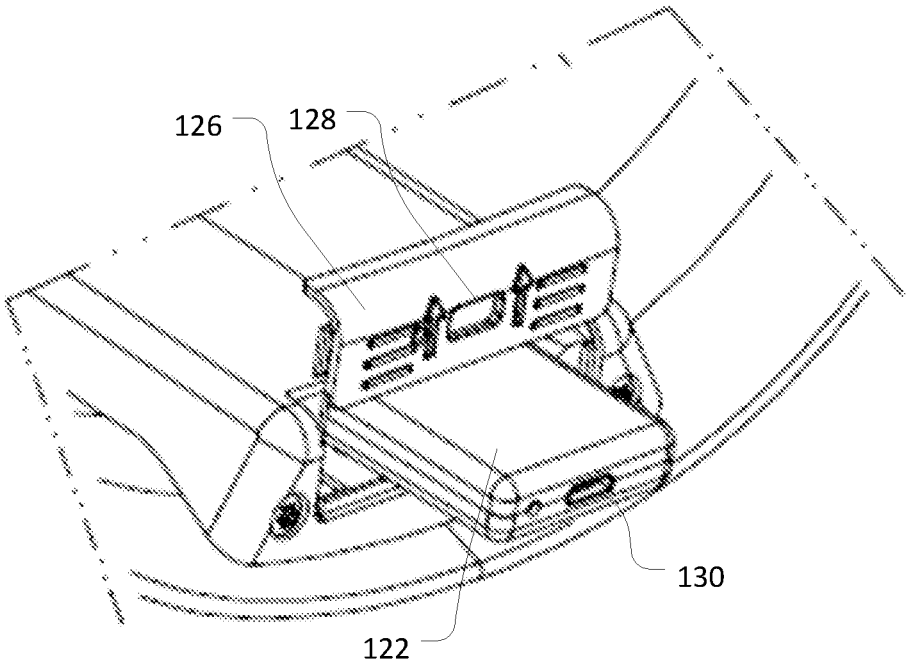
FIG. 11 is a close up view of a battery compartment of the light assembly, showing a door of the battery compartment open and a battery partially extending from the battery compartment, in accordance with various embodiments.
Figure 12:
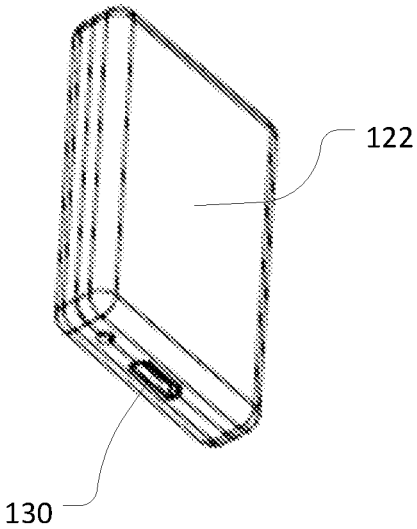
FIG. 12 is a perspective view of the battery of FIG. 11, in accordance with various embodiments.

The light assembly 110 may further include a battery compartment 120 to hold a battery 122 (shown in FIGS. 11 and 12) that powers the lights 112. In some embodiments, the battery compartment 120 may extend down from a rear of the support structure 110 (e.g., so that it is positioned behind the wearer's head). The battery compartment 120 may include a panel 124 to separate the battery 122 from the wearer's head. The battery compartment 120 may further include a door 126 to enable removal of the battery 122. The battery 122 may additionally or alternatively be secured to the battery compartment 120 by one or more screws, ridges, walls, and/or other features. Although a single battery 122 is shown, it will be apparent that some embodiments may use more than one battery. Additionally, the battery 122 may include multiple battery cells within a housing in some embodiments. FIG. 11 illustrates the battery compartment 120 with the door 126 open and the battery 122 partially extended from the battery compartment 120. FIG. 12 illustrates the battery 122 when it is removed from the battery compartment 120.

The battery 122 is preferably rechargeable, however one or more single-use batteries may also be used in some embodiments. In some embodiments, the battery compartment 120 may include a passthrough charge port 128 to enable the battery 122 to be charged while the battery 122 is installed in the battery compartment 120. The passthrough charge port 128 may be in the door 126, as shown, or another portion of the battery compartment 120. The battery 122 may additionally or alternatively include a charge port 130 to engage with the passthrough charge port 128 for charging while the battery 122 is installed and/or enable the battery 122 to be charged while outside of the battery compartment 120.

In various embodiments, the light assembly 104 may further include one or more control elements 132 to control the lights 112. The one or more control elements 132 may include, for example, a button as shown. Additionally, or alternatively, the one or more control elements, may include one or more switches (e.g., toggle switches), sliders, and/or other suitable control mechanisms. In some embodiments, the one or more control elements 132 may be disposed on an arm 134 that extends from the light assembly 104 to an underside of a brim 136 of the outer shell 102. Accordingly, the one or more control elements 132 may be accessible by the wearer of the hard hat 100 while the hard hat 100 is being worn. This feature provides a significant safety benefit, since it can be in violation of safety code and/or otherwise dangerous in some circumstances for the wearer to remove the hard hat 100 even for a short time.

The one or more control elements 132 may be used to power the lights 112 on and off and/or control one or more other operational modes of the lights 112. For example, the one or more operational modes may include, full on, full off, pulsing on (e.g., varying intensity), different colors, and/or other operational modes. In some embodiments, the pulsing operational mode may vary the intensity of the lights 112 over time without turning them completely off (e.g., intensity of 0%).

In one example, a single control element 132 (e.g., button or slider) may be used to cycle through the different operational modes, including on and off. In other embodiments, more than one control element 132 may be included, such as one control element to turn the lights 112 on and off, and a second control element to change the operational mode of the lights 112 when on.

Figure 16:
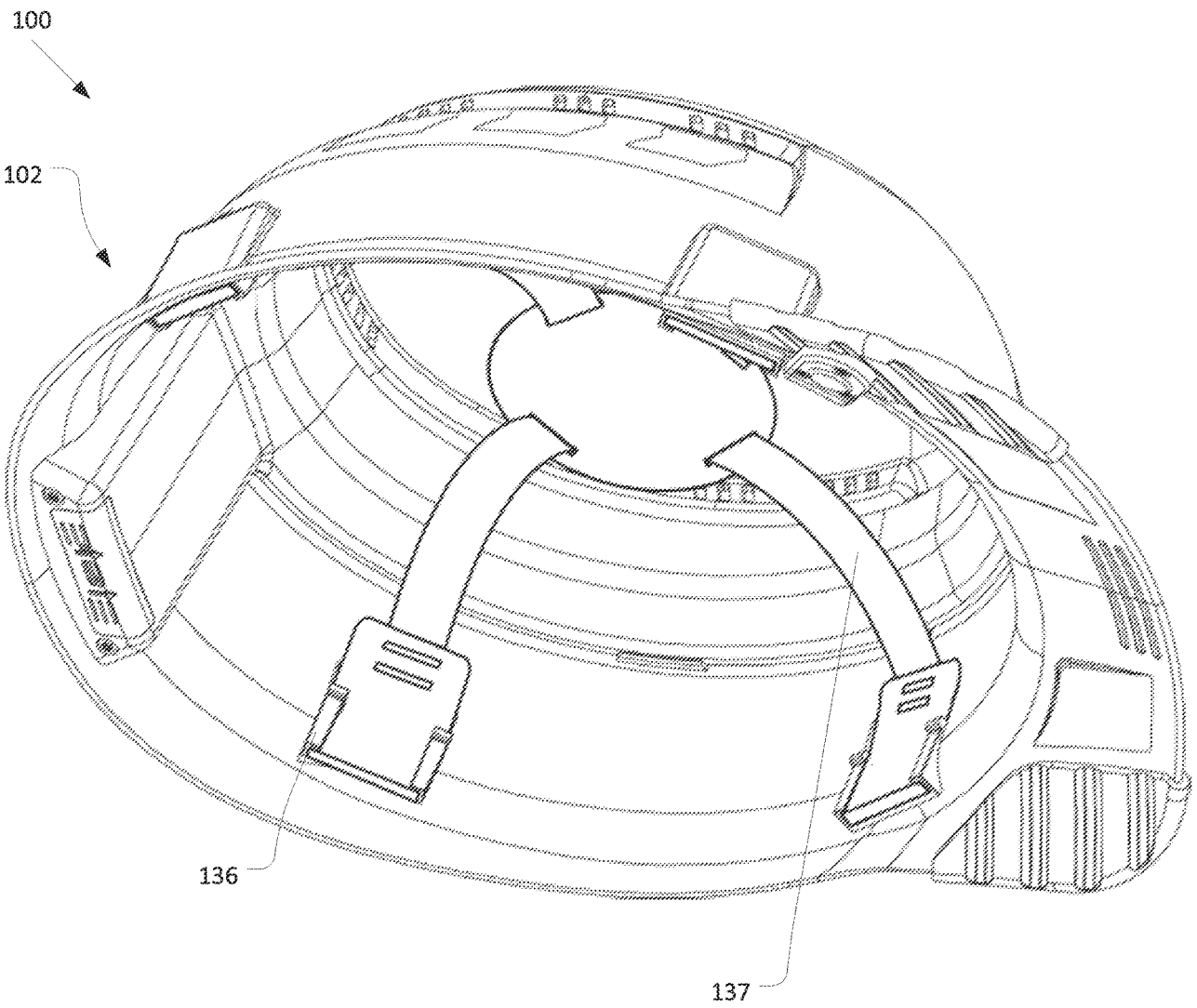
FIG. 16 is a bottom perspective view of the hard hat of FIGS. 1, 2, and 5-10, showing a removable suspension coupled to the hard hat, in accordance with various embodiments.

In embodiments, the hard hat 100 may further include a suspension that is to contact the head of the wearer and separate the inner surface of the outer shell 102 and/or light assembly 104 from the head of the wearer. The suspension may include one or more straps that go around the top of the wearer's head. The suspension may be removably coupled to the outer shell 102 of the hard hat via one or more attachment mechanisms 136 (e.g., a buckle and/or other suitable mechanism). In some embodiments, the suspension may be removed prior to removing or installing the light assembly 104. For example, FIG. 16 illustrates the hard hat 100 with a suspension 137 coupled to the outer shell 102 via the attachment mechanisms 136.

In various embodiments, the light assembly 104 and corresponding outer shell 102 described herein may provide enhanced visibility for the wearer compared with prior solutions. Additionally, the light assembly 104 may be removed from the outer shell 102, enabling the light assembly 104 to be used with another outer shell 102, e.g., when the first outer shell becomes damaged or otherwise compromised. Furthermore, if the light assembly 104 needs to be disposed of, it can be separated from the outer shell 102 to enable responsible disposal of the electronic components in the light assembly 104.

Figure 13:
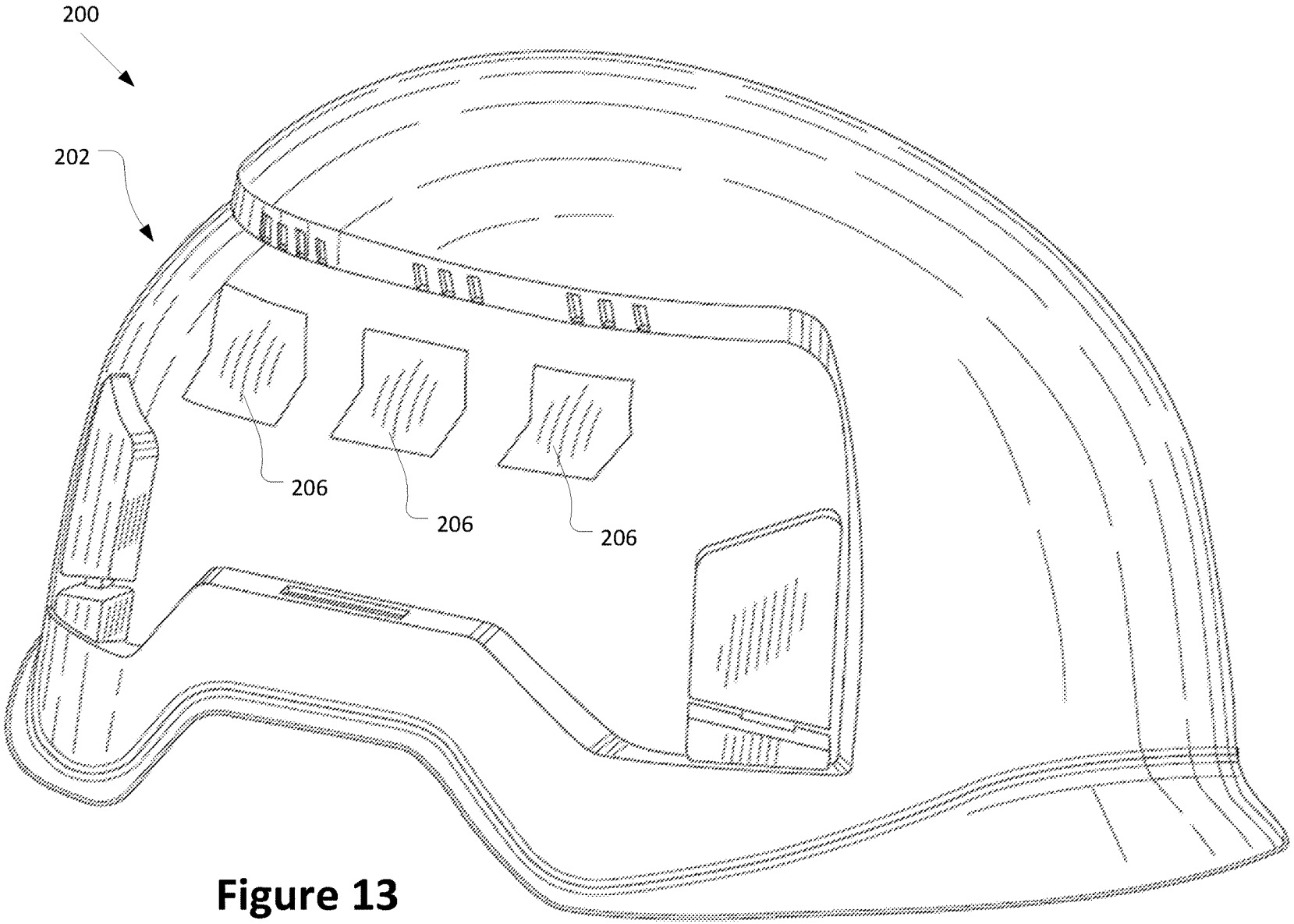
FIG. 13 is a first upper perspective view of another embodiment of a hard hat, in accordance with various embodiments.
Figure 14:
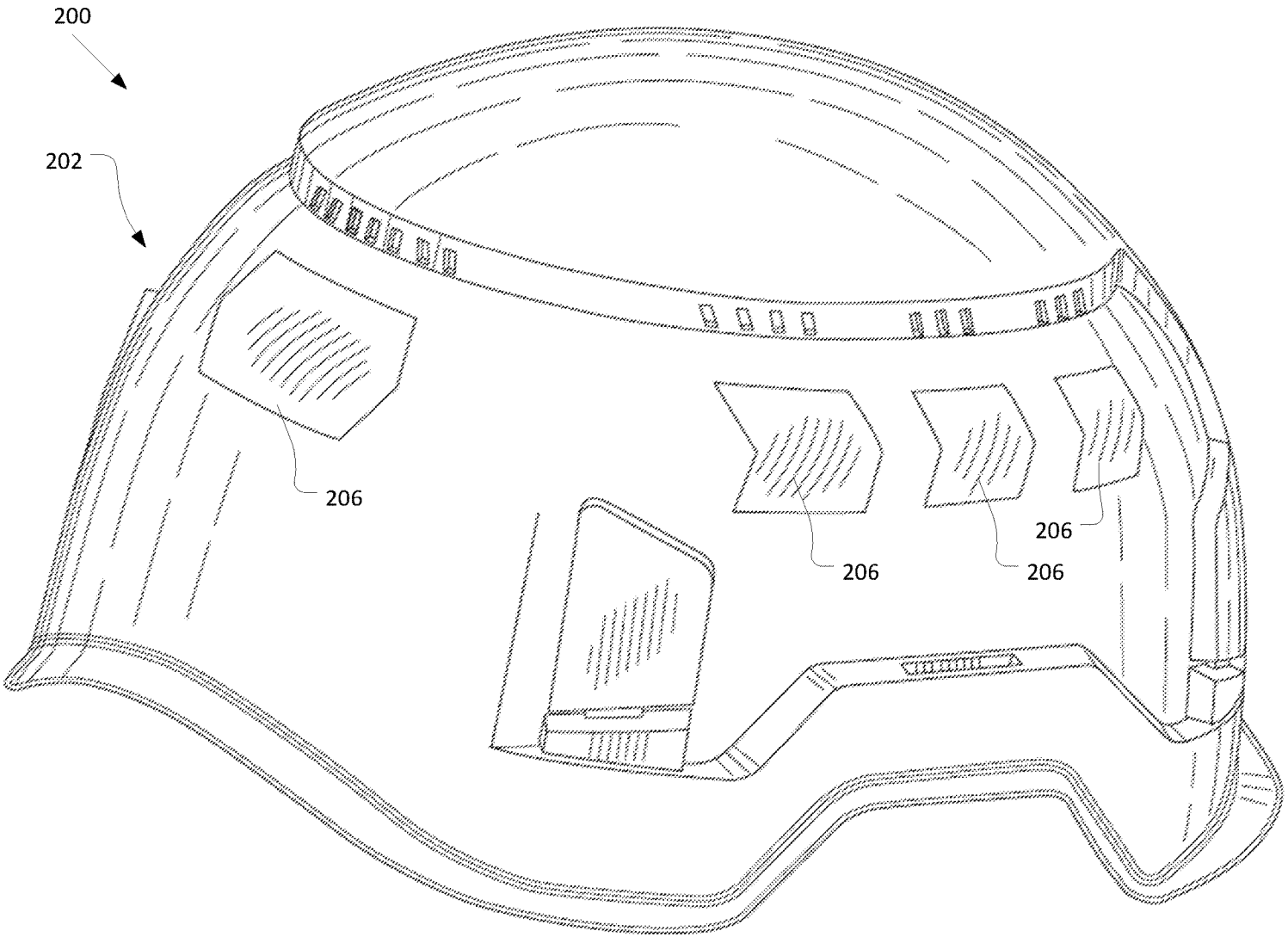
FIG. 14 is a second upper perspective view of the hard hat of FIG. 13, in accordance with various embodiments.
Figure 15:
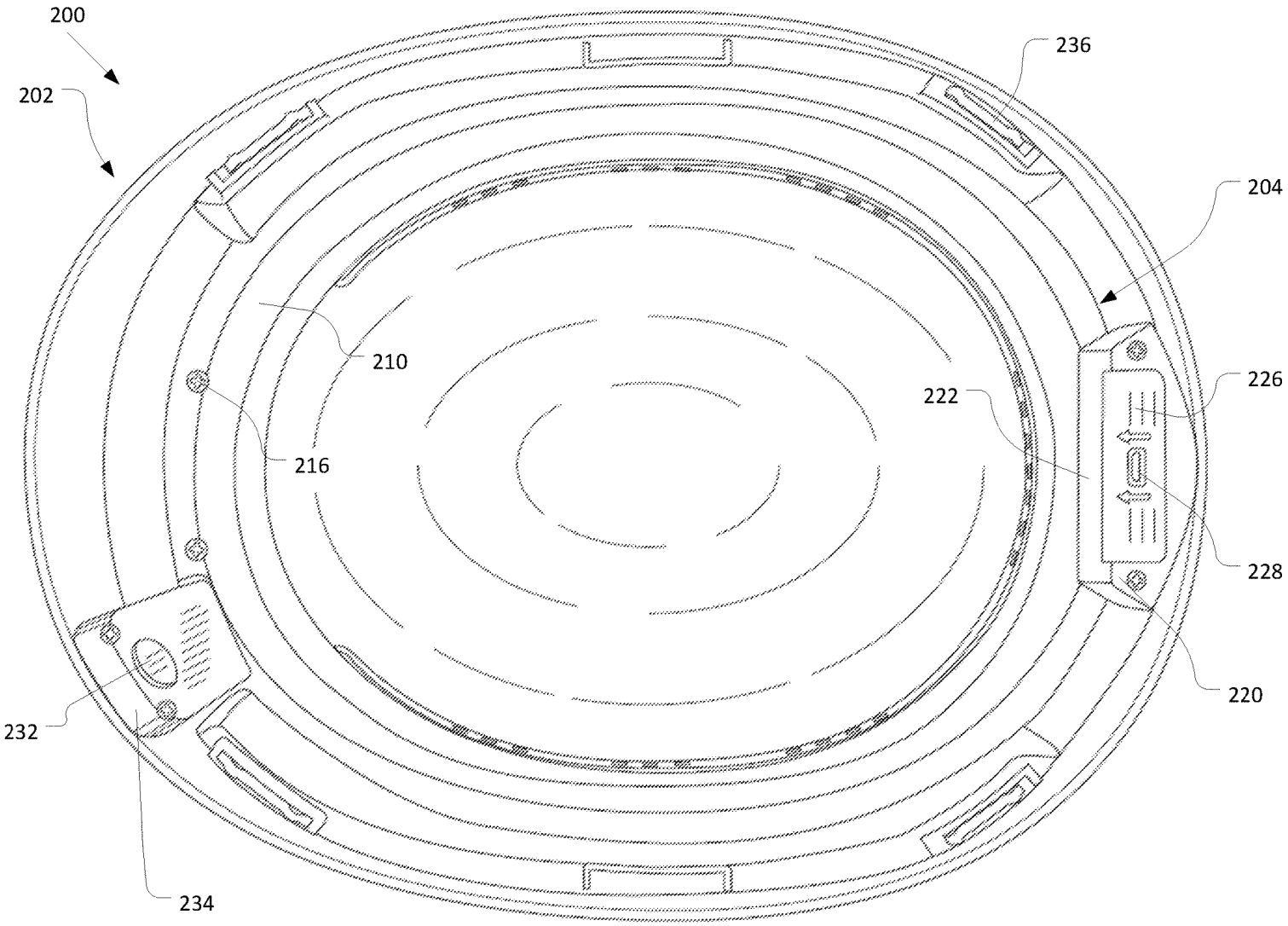
FIG. 15 is a bottom view of the hard hat of FIG. 13, in accordance with various embodiments.

FIGS. 13 to 15 illustrate another embodiment of a hard hat 200 that includes an outer shell 202 and a light assembly 204, in accordance with various embodiments. The light assembly 204 and/or outer shell 202 may have similar features to above-described features of light assembly 104 and/or outer shell 102, respectively. For example, the outer shell 202 includes a plurality of windows 206, and the light assembly 204 includes lights positioned on a support structure 210 behind the windows 206. The light assembly 204 further includes a battery compartment 220 with a door 226 and a passthrough charge port 228. Additionally, the light assembly 204 includes an arm 234 that extends from the support structure 210 and includes a control element 232 on an end of the arm 234 that is accessible to the wearer while the hard hat 200 is being worn.

The hard hat 200 may be suitable for rock climbing and/or other sports. It will be apparent that other configurations of hard hats (also referred to as helmets) may be used within the scope of various embodiments herein.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A hard hat comprising:

an outer shell to absorb impact, wherein the outer shell includes one or more windows; and a light assembly removably coupled to an interior surface of the outer shell, wherein the light assembly includes:

a support structure that has a ring shape or a U-shape; and one or more light emitting diodes (LEDs) coupled to the support structure and positioned behind respective windows of the one or more windows.

2. The hard hat of claim 1, wherein the light assembly further includes:

an elongate arm, wherein a first end of the elongate arm is coupled to the support structure, and wherein the elongate arm extends from the first end to a second end on an underside of a brim of the outer shell; and a power control element on the second end of the elongate arm to control the one or more LEDs.

3. The hard hat of claim 1, further comprising a battery compartment coupled to the support structure to house a battery that is to power the one or more LEDs.

4. The hard hat of claim 3, wherein the battery compartment extends downward from the support structure at a rear of the hard hat and includes a panel to separate the battery from a head of a wearer of the hard hat.

5. The hard hat of claim 3, wherein the battery compartment includes:

a door to enable removal of the battery; and a passthrough charge port to charge the battery while the battery is in the battery compartment.

6. The hard hat of claim 3, further comprising the battery, wherein the battery includes a charge port to enable charging of the battery both when the battery is in the battery compartment and when the battery is outside the battery compartment.

7. The hard hat of claim 1, wherein the support structure is removably coupled to the interior surface of the outer shell by one or more screws.

8. The hard hat of claim 1, wherein the one or more windows includes at least four windows.

9. The hard hat of claim 1, wherein the outer shell further includes attachment mechanisms to receive a removable suspension that is to contact a head of a wearer and separate the head from the outer shell and the light assembly.

10. A light assembly for a hard hat, the light assembly comprising:

a support structure to be removably coupled to an interior surface of an outer shell of the hard hat, wherein the support structure has a ring shape or a U-shape;

light emitting diodes (LEDs) coupled to the support structure and positioned to be behind respective windows in the outer shell;

an elongate arm, wherein a first end of the elongate arm is coupled to the support structure, and wherein the elongate arm extends downward from the support structure; and a power control element on a second end of the elongate arm, opposite the first end, to control the one or more LEDs, wherein the second end of the elongate arm is to be positioned on an underside of a brim of the outer shell when the light assembly is coupled to the outer shell.

11. The light assembly of claim 10, further comprising a battery compartment coupled to the support structure to house a battery that is to power the one or more LEDs.

12. The light assembly of claim 11, wherein the battery compartment extends downward from the support structure at a rear side of the light assembly and includes a panel to separate the battery from a head of a wearer of the hard hat.

13. The light assembly of claim 11, wherein the battery compartment includes:

a door to enable removal of the battery; and a passthrough charge port to charge the battery while the battery is in the battery compartment.

14. The light assembly of claim 11, further comprising the battery, wherein the battery includes a charge port to enable charging of the battery both when the battery is in the battery compartment and when the battery is outside the battery compartment.

15. The light assembly of claim 10, wherein the support structure includes through holes to enable the support structure to be removably coupled to the interior surface of the outer shell by one or more screws.

16. A hard hat comprising:

an outer shell to absorb impact, wherein the outer shell includes one or more windows;

and a light assembly removably coupled to the interior surface of the outer shell, wherein the light assembly includes:

a support structure; and one or more light emitting diodes (LEDs) coupled to the support structure and positioned behind respective windows of the one or more windows.

17. The hard hat of claim 16, wherein the outer shell includes attachment mechanisms to receive a removable suspension.

18. The hard hat of claim 16, wherein the support structure has a ring shape or a U-shape.

19. The hard hat of claim 18, wherein the light assembly further includes:

an elongate arm, wherein a first end of the elongate arm is coupled to the support structure and a second end of the elongate arm, opposite the first end, is coupled to an underside of a brim of the outer shell; and a power control element on the second end of the elongate arm to control the one or more LEDs.

* * * * *